US010173879B1

(12) United States Patent
Michel et al.

(10) Patent No.: US 10,173,879 B1
(45) Date of Patent: Jan. 8, 2019

(54) CORK STOPPER SHAVING DEVICE

(71) Applicant: EYEON INNOVATIONS, LLC, Carlsbad, CA (US)

(72) Inventors: Anne Marie Michel, Carlsbad, CA (US); David William Reed, Carlsbad, CA (US)

(73) Assignee: EYEON INNOVATIONS, LLC, Carlsbad, CA (US)

( * ) Notice: Subject to any disclaimer, the term of this patent is extended or adjusted under 35 U.S.C. 154(b) by 0 days.

(21) Appl. No.: 15/688,782

(22) Filed: Aug. 28, 2017

(51) Int. Cl.
*B67B 7/44* (2006.01)
*B26B 11/00* (2006.01)

(52) U.S. Cl.
CPC ..... *B67B 7/44* (2013.01); *B26B 11/00* (2013.01)

(58) Field of Classification Search
CPC ..... Y10T 83/04; Y10T 83/00; Y10T 83/02; B67B 7/44; B26B 11/00
USPC ..... 30/451, 454, 455, 457
See application file for complete search history.

(56) References Cited

U.S. PATENT DOCUMENTS 2,299,799 A * 10/1942 Correll ..... B43L 23/08 30/457
3,074,162 A * 1/1963 Lentini ..... B67B 7/30 30/130
4,269,523 A * 5/1981 Kay ..... B43L 23/08 401/51
4,513,798 A * 4/1985 Luttgens ..... A45D 40/08 144/28.1
6,286,218 B1 * 9/2001 Luttgens ..... B43L 23/08 144/28.11

* cited by examiner

*Primary Examiner* — Phong Nguyen
(74) *Attorney, Agent, or Firm* — Coastal Patent Law Group, P.C.

(57) ABSTRACT

The disclosure concerns a cork stopper shaving device with shaving elements fixed at predetermined angles and configured for cutting material from a cork stopper and tapering an edge thereof, such that the cork stopper, when cut, becomes modified for easy re-insertion back into a bottle or container.

14 Claims, 9 Drawing Sheets

CORK STOPPER SHAVING DEVICE

BACKGROUND OF THE INVENTION

Field of the Invention

This invention relates to bottle stoppers and related accessories, and more particularly, to a cork stopper shaving device for shaving the edges of a cork at an angle sufficient to provide for easy reinsertion of the cork back into an orifice of a bottle.

Description of the Related Art

Cork stoppers are generally made out of the bark of a cork oak tree, though modernly synthetic corks are becoming increasingly popular. With respect to cork oak tree, the molecular structure of the bark provides a water tight seal to a bottle or container which utilizes an orifice for closure. Synthetic cork stoppers are designed to provide similar results.

Cork stoppers are the industry standard for sealing wine bottles and other containers. Additionally, cork stoppers are not only made up of cork oak tree bark, but may also be made of alternative materials including synthetic polymer materials; for purposes of this disclosure, all such stoppers, whether made of cork or other materials, are collectively referred to herein as "cork stoppers".

The colors, textures, and printed designs of cork stoppers make them unique and desirable to a consumer.

As an illustrative example, after removing a cork stopper from a new bottle of wine, the wine consumer will pour a glass and attempt to find a way to reseal the bottle. The consumer might attempt to reinsert the cork that was removed from the bottle, only to find that the cork has expanded and no longer fits. Furthermore, should the consumer attempt to intensely force the expanded cork back into the bottle, there is great potential for the bottle to slip and tip over, spilling the wine on the consumer and surrounding area. This leaves the wine consumer frustrated and searching for a way to easily reseal and store their new bottle of wine.

Thus, there remains a need in the art for a solution which allows for easy reinsertion of a cork stopper back into a bottle or container, after the opening thereof.

SUMMARY OF THE INVENTION

This disclosure concerns a cork stopper shaving device, the device including: a receptacle portion and a cutting assembly, the cutting assembly being adapted to couple with the receptacle portion to form the cork cutting device. The cork stopper shaving device is adapted to receive a cork stopper within a conical volume of the cutting assembly and engage an edge of the inserted cork stopper with shaving elements for shaving the cork stopper. The receptacle portion is adapted to catch the resulting shavings.

The receptacle portion includes: a base, and one or more walls extending upwardly from the base to a periphery. The periphery is defined at a top end of the receptacle portion. The base and one or more walls thereby form a receptacle volume therebetween.

The cutting assembly includes: a planar lid portion, a bottom portion, and a conical body extending therebetween. The planar lid portion having a first aperture extending therethrough, the first aperture having a first diameter associated therewith. The conical body extending between the planar lid portion and the bottom portion forms an inner-conical surface, including: a plurality of slots extending through the conical body, and a plurality of shaving elements. Each shaving element of the plurality of shaving elements is disposed adjacent to one of the plurality of slots and configured for cutting material exposed therethrough.

In this regard, a cork stopper shaving device is provided with shaving elements fixed at predetermined angles for cutting material from a cork stopper and tapering an edge thereof such that the cork stopper, when cut, becomes modified for easy re-insertion back into a bottle or container.

BRIEF DESCRIPTION OF THE DRAWINGS

These and other aspects are described in the appended details and descriptions, particularly when referenced in conjunction with the following drawings, wherein.

DETAILED DESCRIPTION OF THE PREFERRED EMBODIMENTS

For purposes of explanation and not limitation, details and descriptions of certain preferred embodiments are hereinafter provided such that one having ordinary skill in the art may be enabled to make and use the invention. These details and descriptions are representative only of certain preferred embodiments, however, these and a myriad of other embodiments which will not be explicitly described will be readily understood by one having skill in the art upon a thorough review hereof. Accordingly, any reviewer of the instant disclosure should interpret the scope of the invention by the claims and not the description, and such scope shall not be limited by the embodiments described and illustrated herein.

In a general embodiment, a cork stopper shaving device includes a receptacle portion and a cutting assembly adapted to couple therewith. The cutting assembly is configured to cut a portion of the cork stopper when the cork stopper is rotatably translated within the cutting assembly.

In this regard, the cork stopper shaving device is provided with shaving elements fixed at predetermined angles for cutting material from a cork stopper and tapering an edge thereof such that the cork stopper, when cut, becomes modified for easy re-insertion back into a bottle or container.

The receptacle portion includes: a base, and one or more walls extending upwardly from the base to a periphery defined at a top end of the receptacle portion; wherein the base and one or more walls collectively form a receptacle volume therein.

The cutting assembly includes: a planar lid portion, a bottom portion, and a conical body extending therebetween. The planar lid portion includes a first aperture extending through a volume of the planar lid portion; the first aperture having a first diameter associated therewith. The conical body extending between the planar lid portion and the bottom portion forms an inner-conical surface, comprising: a plurality of slots extending through the conical body, and a plurality of shaving elements, each shaving element of the plurality of shaving elements being disposed adjacent to one of the plurality of slots and configured to cut material exposed therethrough.

Figure 1:
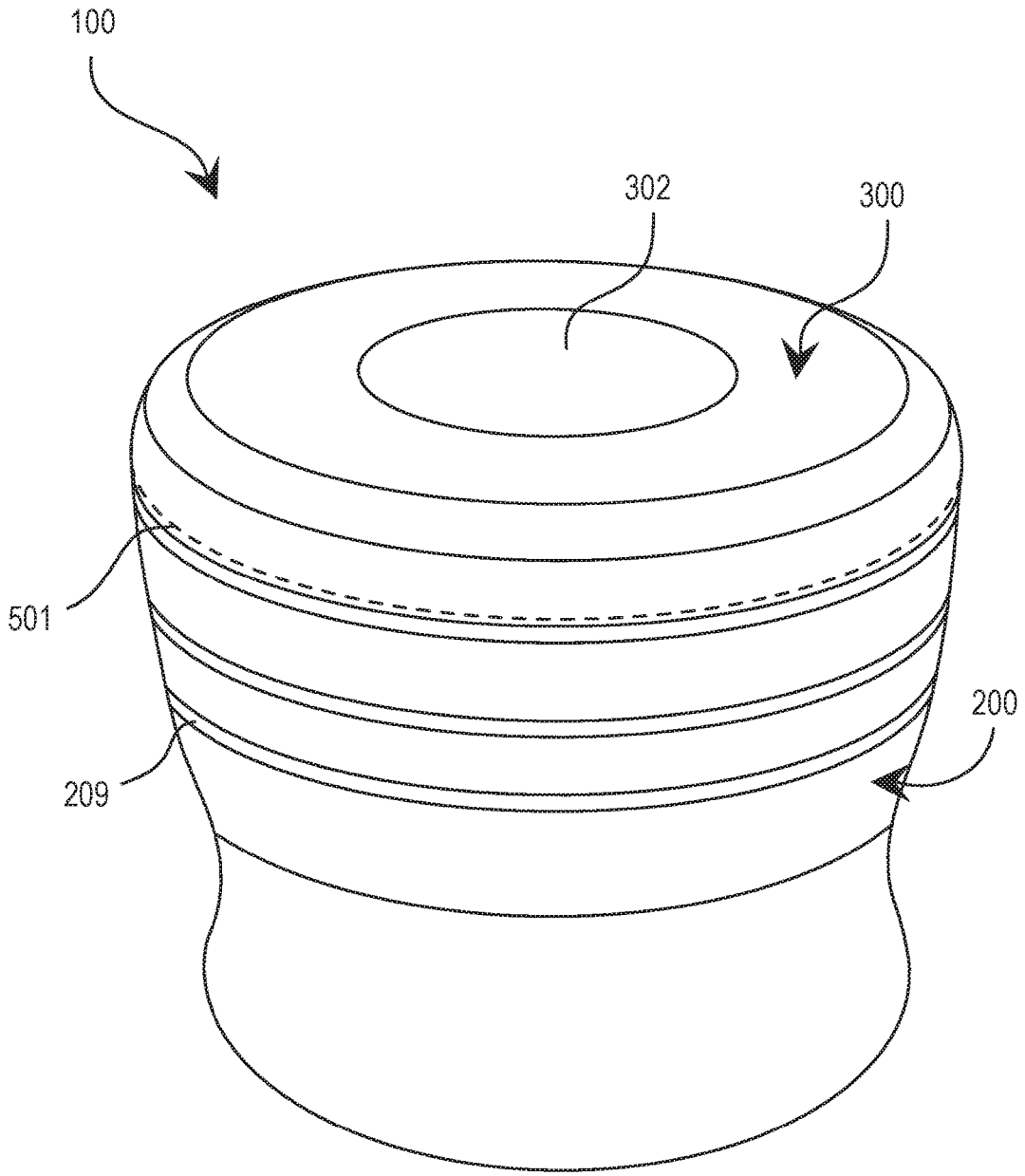
FIG. 1 shows a perspective view of a cork stopper shaving device in accordance with a first embodiment; the cork stopper shaving device being illustrated in a closed configuration.

Now, turning to the drawings, FIG. 1 shows a cork stopper shaving device 100 in accordance with a first embodiment, wherein the cork stopper shaving device includes a receptacle portion 200 and a cutting assembly 300. The cork stopper shaving device is shown configured in a closed configuration, wherein the cutting assembly is coupled to the receptacle portion at a mating 501 thereof. The cutting assembly includes a first aperture 302 configured to receive at least a portion of a cork stopper for cutting. In addition, the receptacle portion includes an ergonomic design, with optional grooves 209 provided on the outer surface thereof. In this regard, the receptacle portion may comprise a contoured surface for ergonomic gripping by a user.

Figure 2:
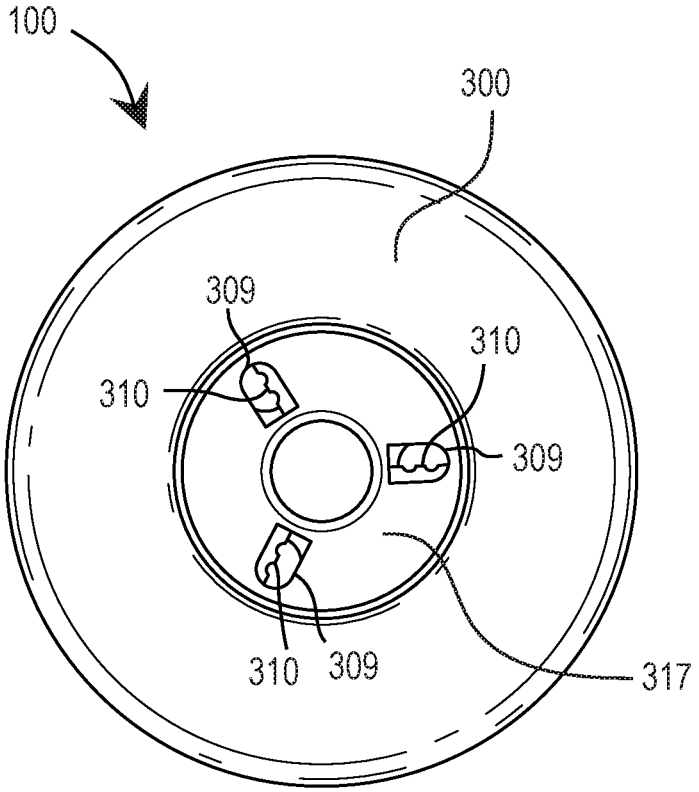
FIG. 2 shows a top view of the cork stopper shaving device in accordance with the first embodiment thereof.

FIG. 2 shows the cork stopper shaving device 100 in accordance with the first embodiment, the cork stopper shaving device is shown with a cutting assembly 300 including three slots 309 and three adjacent shaving elements 310 each extending through an inner conical surface 317 of the conical body. Although the first embodiment integrates three slots and corresponding shaving elements, it will be understood by one with skill in the art that two, four, or any plurality of slots and corresponding shaving elements may be similarly implemented.

Figure 3:
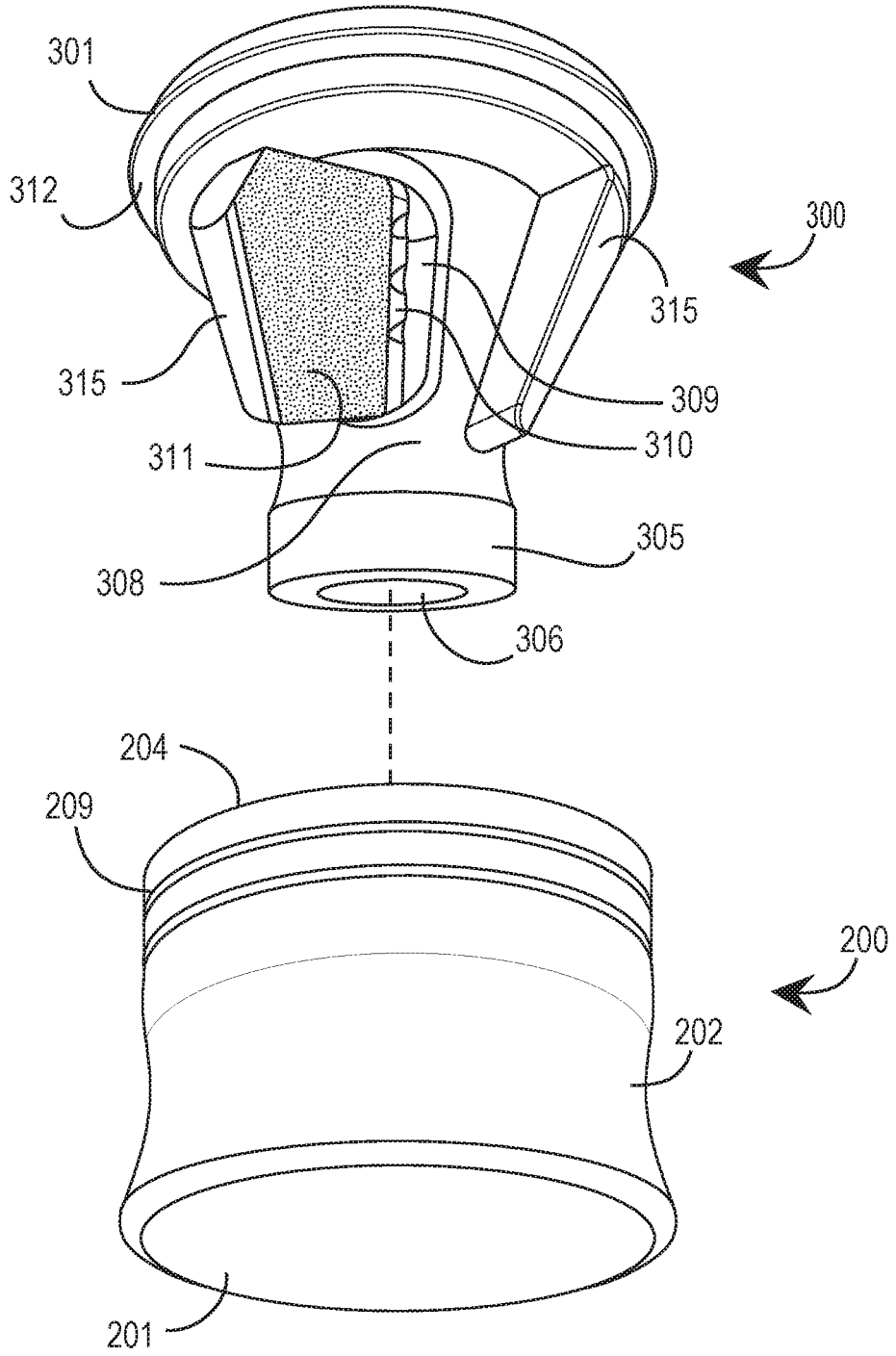
FIG. 3 shows a exploded view of the cork stopper shaving device in accordance with the first embodiment, wherein a cutting assembly is separated from a receptacle portion.

FIG. 3 shows the cork stopper shaving device in accordance with the first embodiment, wherein the cork stopper shaving device includes a receptacle portion 200 and a cutting assembly 300. Here, the cutting assembly 300 is decoupled from the receptacle portion 200. Note that the preferred configuration for use of the cork stopper shaving device is the closed configuration (See FIG. 1) with the terminal edge 312 of the cutting assembly mated (501, FIG. 1) to a periphery (203, FIG. 5) of the receptacle portion 200. Thus, the planar lid portion of the cutting assembly may comprise a terminal edge, wherein the cutting assembly is adapted to couple with the receptacle portion at a mating of the terminal edge and the periphery, respectively.

In this embodiment, the receptacle portion 200 includes a base 201, with one or more walls 202 extending upwardly from the base 201 to the periphery (203, FIG. 5) defined at a top end 204 of the receptacle portion. It is proposed that by "one wall" it is meant a single annular wall structure, whereas by "more walls" it is meant two or more walls, such as three walls which would yield, for example, a triangular cross-section. Optionally, grooves 209 can be integrated for ergonomic and gripping enhancement.

The cutting assembly 300, shown exploded from the receptacle portion 200, includes a planar lid portion 301, a bottom portion 305, and a conical body 308 extending therebetween. The conical body 308 including a plurality of slots 309 extending through the conical body, with a plurality of shaving elements 310 being disposed adjacent to each of the plurality of slots 309 and configured for cutting material exposed therethrough. A plurality of blade reinforcements 315 are shown formed on the conical body 308 of the cutting assembly, and designed to reinforce the attached blade or "shaving element".

The bottom portion 305 is shown with a second aperture 306 extending therethrough; however, a second aperture is optional and not required. When a cork is modified using the cork stopper shaving device, the plurality of slots 309 disposed on the conical body 308, and optionally the second aperture 306 of the bottom portion 305, allow cork shavings to pass through each of the slots and the optional second aperture, thereby falling into and being captured by the receptacle portion, where they can be stored and later disposed of. To be clear, a second aperture is not required as the slots should be sufficient to pass shavings into the receptacle portion.

While the embodiment of FIG. 3 illustrates molded conical body with blade reinforcements 315, which form a monolithic piece made up of the planar lid portion, conical body and bottom portion, it would be appreciated by one with skill in the art that the blade reinforcements may alternatively comprise bonding material (not forming part of the conical body) which is applied to join the conical body and rear portion of the blade (also called "shaving element") 311.

Figure 4:
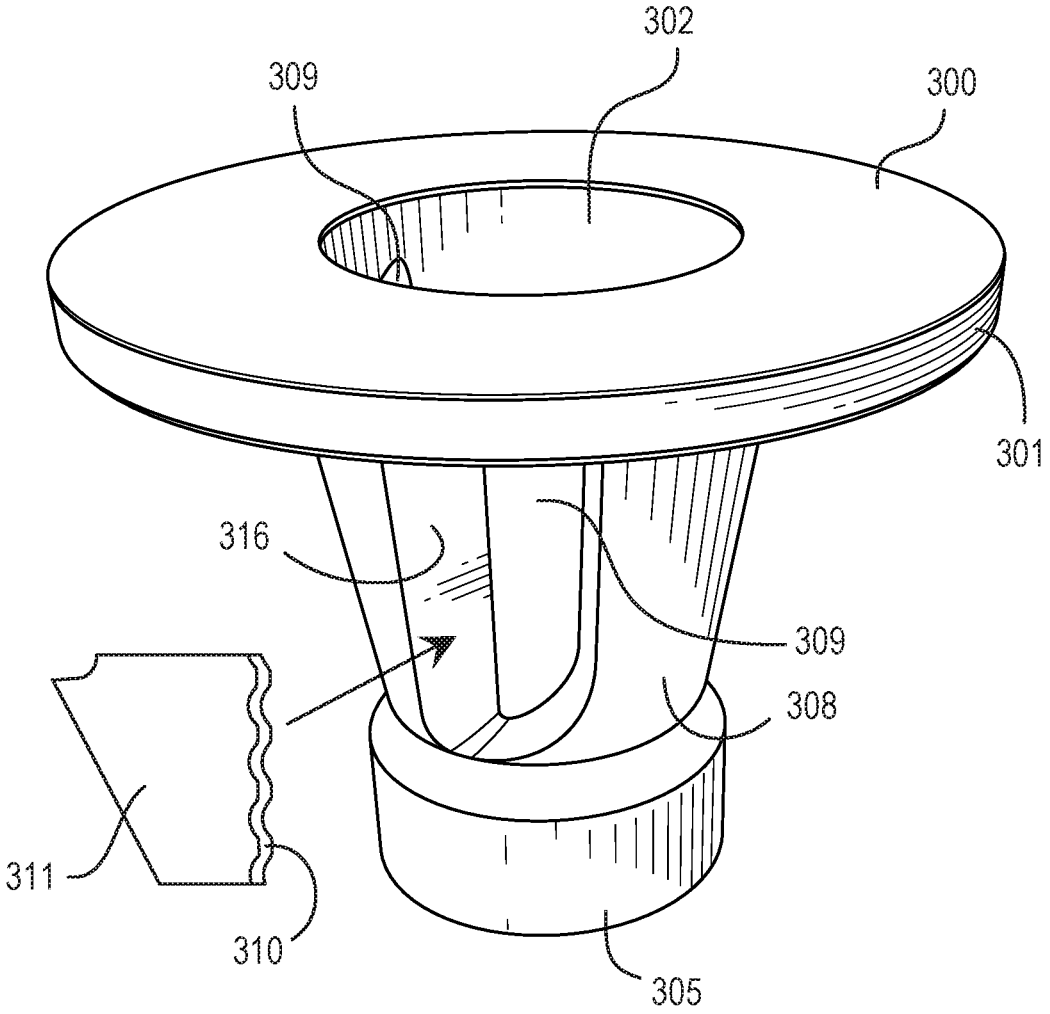
FIG. 4 shows the cork stopper shaving device in accordance with a second embodiment, wherein a serrated-blade (shaving element) is configured to attach with a blade engagement surface of the cutting assembly.

FIG. 4 shows the cutting assembly 300 in accordance with a second embodiment, wherein a serrated-blade 311 is configured to attach to the cutting assembly at a blade engagement surface 316. Optionally, bonding material may be further added at a joinder of the rear portion of the blade and the conical body (not shown), or alternatively, the conical body can be molded to include the blade reinforcement as indicated in FIG. 3 and the associated descriptions. As shown, blade reinforcements are not molded with the conical body in the second embodiment.

Here, the cutting assembly 300 includes a planar lid portion 301 with a first aperture 302, and an bottom portion 305. A conical body 308 extends between the planar lid portion 301 and the bottom portion 305. It would be recognized by one having skill in the art that the lid portion need not be planar; however, such a planar surface is illustrated as the preferred embodiment. The conical body 308 includes a plurality of slots 309 extending through the conical body, with one of a plurality of shaving elements 310 disposed adjacent to each of the plurality of slots 309, wherein the plurality of shaving elements are configured for cutting material exposed through each of the plurality of slots 309.

The serrated blade 311 can be bonded to the blade engagement surface 316 using an adhesive, glue or solvent bonding agent; or any other bonding agent understood by one with skill in the art. Alternatively, a blade may be mounted to the blade engagement surface by screws, or any other technique commonly known and used in the art.

In some embodiments, the serrated blade comprises a micro serrated blade. In other embodiments, a straight edge blade (non-serrated) may be similarly implemented.

Figure 5:
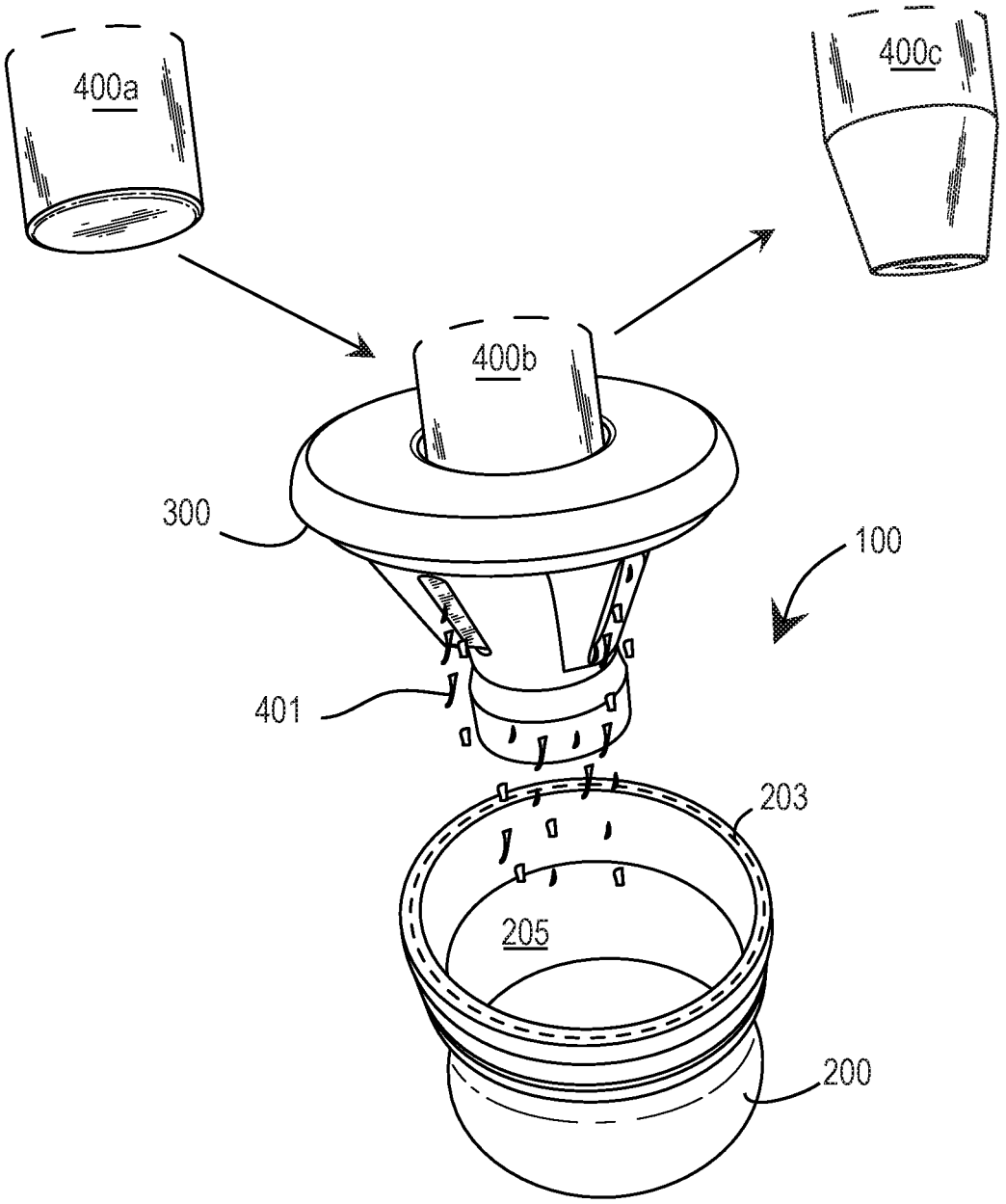
FIG. 5 illustrates a process wherein a cork is modified using the cork stopper shaving device.

FIG. 5 shows a perspective view of a cork stopper 400*a*; 400*b*; 400*c* being modified in accordance with a third embodiment. For convenience, the cork stopper shaving device 100 is shown in an open configuration with the cutting assembly 300 decoupled from the receptacle portion 200.

In FIG. 5, a typical cork stopper 400*a* is shown having an industry standard cylindrical profile. A process for cutting the cork stopper using the cork stopper shaving device is illustrated in accordance with one example. Here, the cork 400*b* is inserted into the first aperture of the cutting assembly 300. With at least a portion of the cork stopper 400*b* inserted into the cutting assembly, a simultaneously downward and rotational force is applied upon the cork stopper, the force being applied in a rotational direction opposing the blades of the cutting assembly, such that material from the cork is removed. The downward force applied to the cork causes a portion of the cork stopper to extend through each of the plurality of slots. Meanwhile, the rotational force applied to the cork allows the plurality of shaving elements of the cutting assembly 300 to cut shavings 401 off of the cork. The plurality of slots disposed adjacent to the plurality of shaving elements on the conical body allow cork shavings to pass through the cutting assembly to be captured within the receptacle volume 205 of the receptacle portion 200, where the shavings can be stored and later disposed of. The result is a modified cork stopper 400*c* with a tapered profile that is capable of being reinserted back into a container with gradual force and less resistance.

Again note that the preferred configuration for use of the cork stopper shaving device 100 is the closed configuration (See FIG. 1) with the terminal edge of the cutting assembly 300 mated to a periphery 203 of the receptacle portion 200.

Also, FIG. 5 shows the cork cutting assembly being used to modify a cork stopper. The cork cutting assembly can modify a variety of stoppers for use with, for example but not limited to: olive oil bottles; artisan vinegar bottles; miscellaneous spirits; vessels storing small-particle dry solids such as spices and herbs.

Figure 6A:
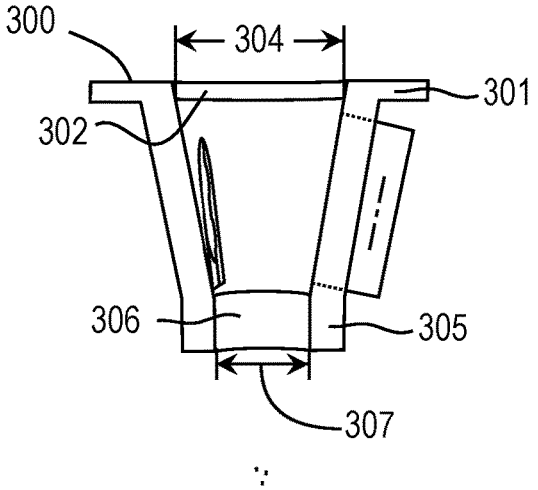
FIG. 6A shows a cross-sectional view of the cutting assembly of the cork stopper shaving device in accordance with various embodiments.

The dimensions of the cork cutting assembly determine the properties of the resulting contour of cork stoppers as-modified using the device. FIG. 6A shows a cross-sectional view of the cutting assembly 300 in accordance with an embodiment. The cutting assembly includes: a planar lid portion 301 having a first aperture 302 extending through a volume of the planar lid portion, the first aperture 302 having a first diameter 304 associated therewith. In addition, an bottom portion 305 is shown having a second aperture 306 extending through a volume of the bottom portion 305, the second aperture 306 having a second diameter 307 associated therewith, wherein the second diameter 307 is smaller than the first diameter 304.

Figure 6B:
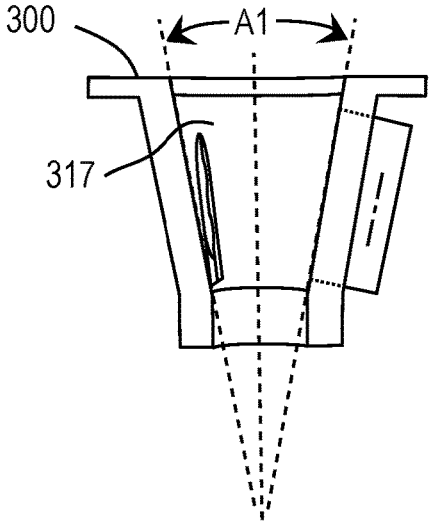
FIG. 6B shows a cross-sectional view of the cutting assembly of the cork stopper shaving device, an opening angle of the cutting assembly defining an inner conical surface.

FIG. 6B shows a cross-sectional view of the cutting assembly 300, the cutting assembly having an opening angle A1 along which an inner conical surface 317 extends.

In one embodiment, the inner-conical surface defines an opening angle A1 between 5 degrees and 40 degrees. Other angles may be preferred depending on manufacturer or consumer requirements.

Figure 6C:
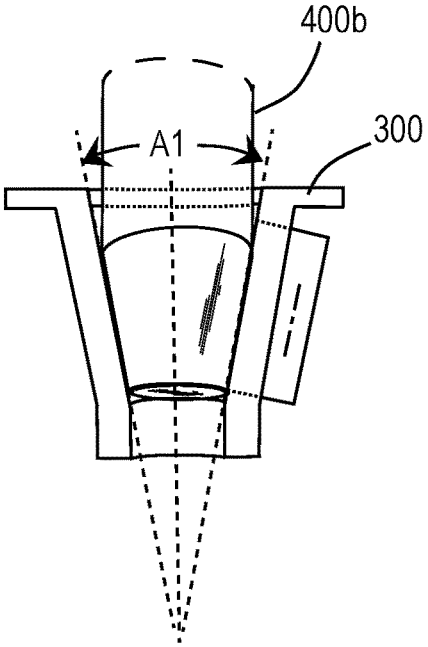
FIG. 6C shows a cross-sectional view of the cutting assembly of the cork stopper shaving device, with a cork stopper inserted into the cutting assembly, wherein the opening angle defines a contour of the cork as the cork is modified.

FIG. 6C illustrates a technique wherein the opening angle A1, and corresponding inner conical surface resulting therefrom, shape a resulting contour of a cork 400*b* subsequent to cutting thereof. Here, the cork is cut such that a tapered surface is created that resembles the inner conical surface of the cutting assembly 300.

Figure 7A:
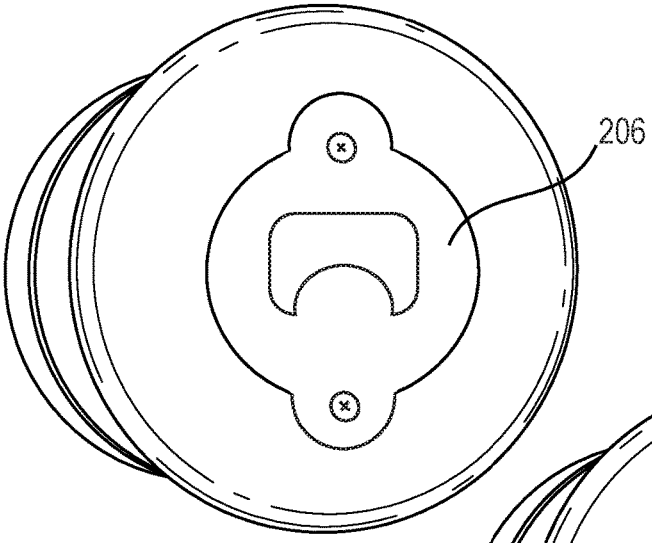
FIG. 7A shows a bottom view of a cork stopper shaving device in accordance with another embodiment, wherein the receptacle portion includes a bottle opener housed within a base thereof.

FIG. 7A shows a bottom view of the cork stopper shaving device in accordance with another embodiment, the cork stopper shaving device including a bottle opener 206 positioned on the base of the receptacle portion. As one with skill in the art might appreciate, in some embodiments the bottle opener may include a plate type bottle opener as shown mounted to the base of the receptacle portion. Similarly, any type of bottle opener commonly known and used in the art may be substituted, including, among others, a pivotally attached bottle opener, or any other variation of a bottle opener appreciated by one with skill in the art. The bottle opener may be implemented flush with a surface of the base, for example, the bottle opener may be configured to nest within a cavity disposed on a surface of the receptacle portion.

Figure 7B:
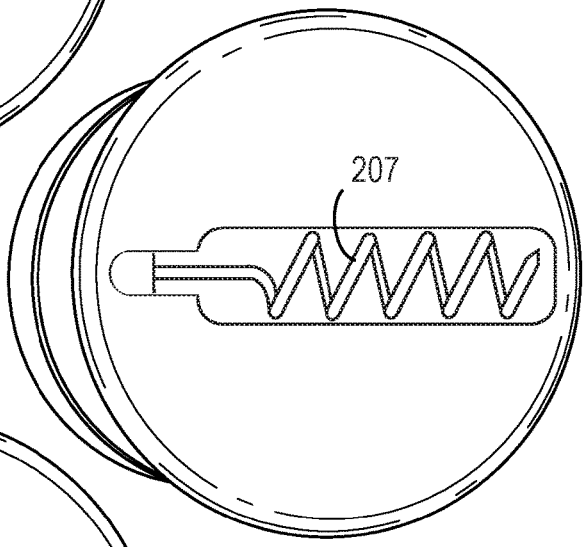
FIG. 7B shows a bottom view of a cork stopper shaving device in accordance with another embodiment, wherein the receptacle portion includes a corkscrew housed within a base thereof.
Figure 7C:
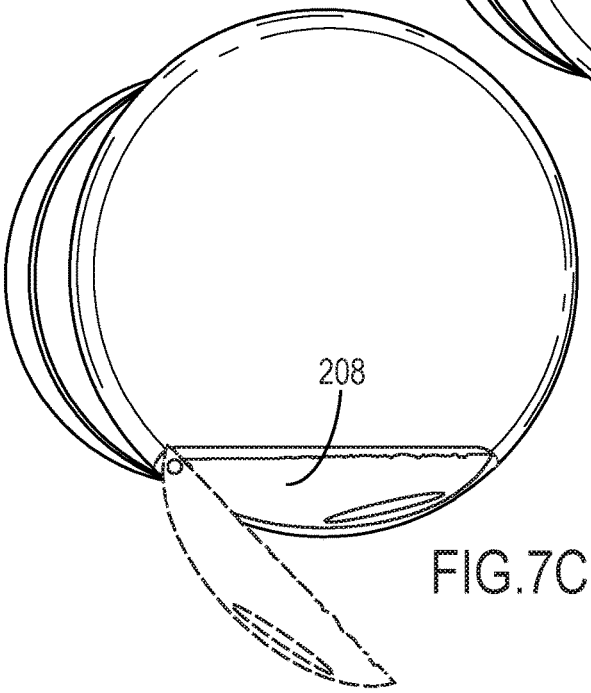
FIG. 7C shows a bottom view of a cork stopper shaving device in accordance with another embodiment, wherein the receptacle portion includes a foil knife housed within a base thereof.

FIG. 7B shows a bottom view of the cork stopper shaving device, the device including a corkscrew 207 housed within the base of the receptacle portion. As one with skill in the art might appreciate, any type of corkscrew commonly known and used in the art may be implemented. The corkscrew may be pivotally attached and configured to nest within a cavity of the receptacle portion. In some embodiments, the corkscrew is adapted to nest into the cavity when configured in a first configuration, and the corkscrew is further adapted to extend outwardly from the receptacle portion when configured in a second configuration FIG. 7C shows a bottom view of the cork stopper shaving device, the device including a foil knife 208. As one with skill in the art would appreciate, any type of foil knife commonly known and used in the art may be similarly implemented.

In some embodiments, the foil knife can be pivotally attached and configured to nest within a cavity disposed on a surface of the receptacle portion.

In certain embodiments, the foil knife is adapted to nest into a cavity disposed about the receptacle portion when configured in a first configuration, and the foil knife is further adapted to extend outwardly from the receptacle portion when configured in a second configuration.

Figure 8:
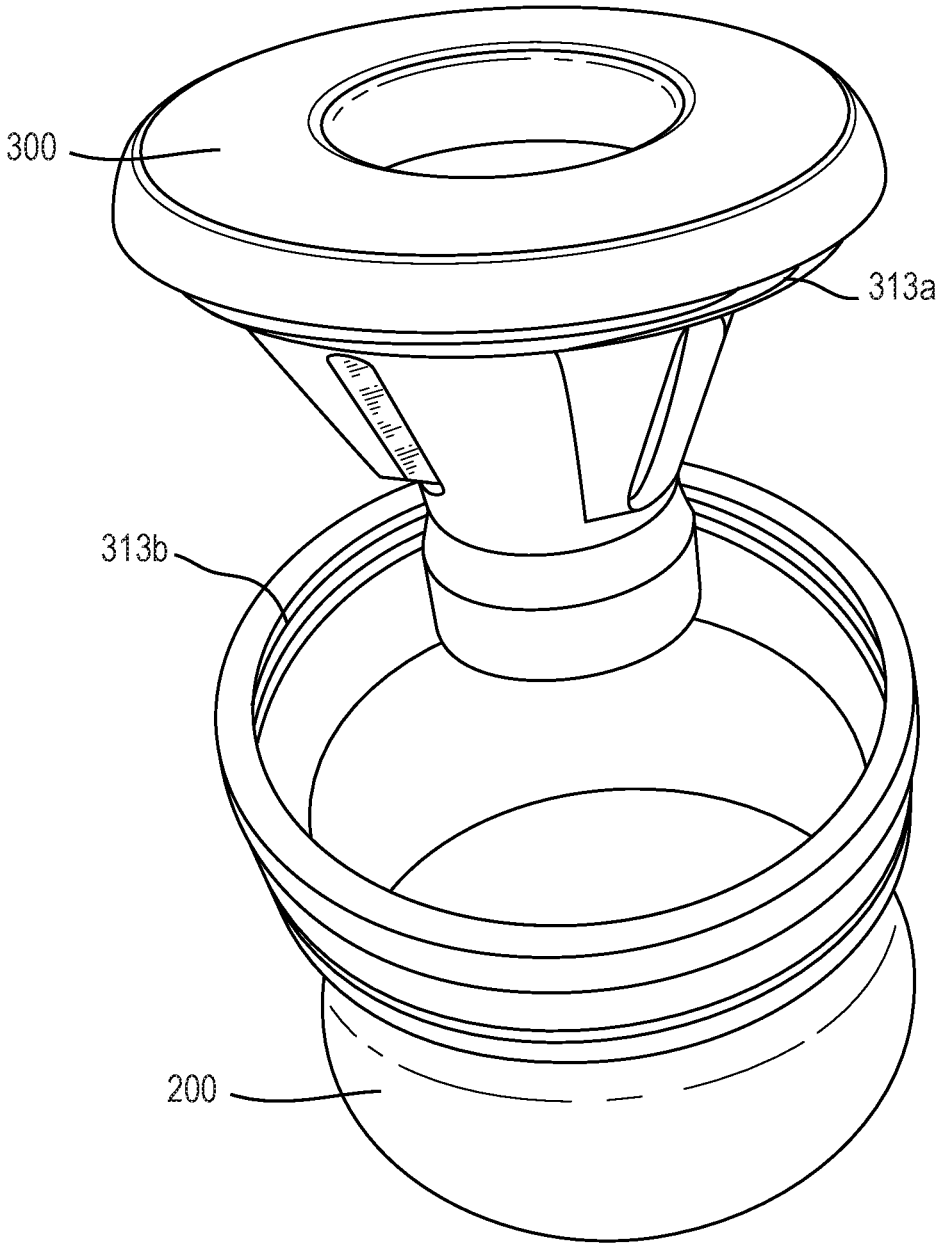
FIG. 8 shows the cork stopper shaving device in yet another embodiment, wherein the cutting assembly and receptacle portion each include complimentary threads for a threaded engagement therebetween.

FIG. 8 shows a perspective view of a cork stopper shaving device in accordance with another embodiment. Here, the cork stopper shaving device is shown in an open configuration with the cutting assembly 300 decoupled from the receptacle portion 200, wherein the cutting assembly and the receptacle portion are each configured with complementary threads 313*a*, 313*b* providing for a threaded engagement. Thus, the lid portion can be coupled to the receptacle portion via a threaded engagement therebetween.

In certain embodiments, the cutting assembly can be coupled to the receptacle portion by alternative means. For example, the lid portion can be coupled to the receptacle portion via a friction fitment formed therebetween as would be appreciated by one having skill in the art with reference to at least FIGS. 1-3 and the associated descriptions.

Figure 9:
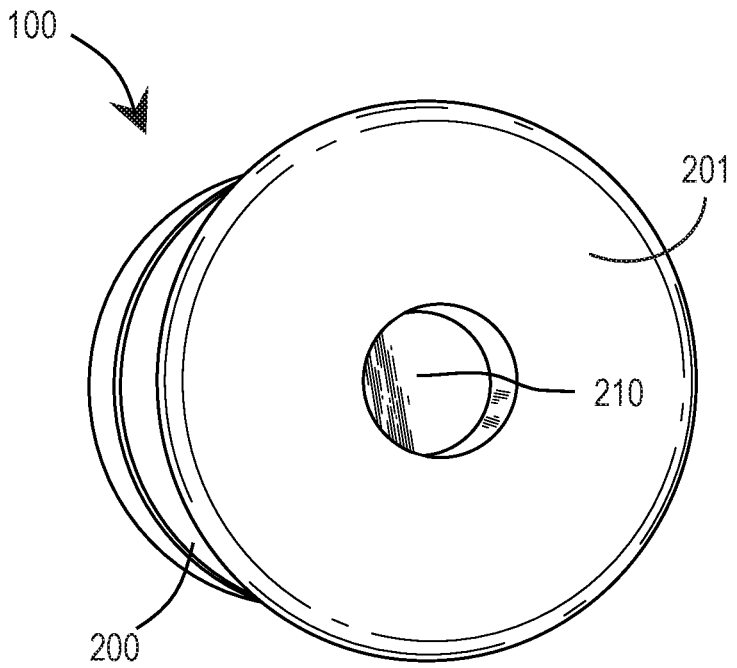
FIG. 9 shows a bottom view of the cork stopper shaving device, wherein a cavity is disposed about the base of the receptacle portion for pressing the cork into the bottle or container.

FIG. 9 shows a bottom view of cork stopper shaving device 100 in accordance with another embodiment. The device 100 includes a cavity 210 disposed on the base of the receptacle portion 200. The cavity 210 extends into the base of the receptacle portion, and is configured to receive at least a portion of a cork therein for providing leverage and allowing a user to firmly press the modified cork back into a container.

Finally, in another aspect as would be appreciated by one having skill in the art, a method for modifying a cork stopper for reuse includes: (i) providing a cork stopper shaving device as described herein; (ii) inserting the cork stopper into an opening of the cork stopper shaving device; (iii) applying a rotational force to turn the cork stopper about an inner conical surface of the cork stopper shaving device for creating a tapered edge about the cork stopper periphery, wherein the tapered edge allows for easy insertion of the modified cork stopper into an orifice of a bottle. The method may be modified in accordance with the details described above or otherwise in accordance with the ordinary level of skill in the art.

Now, although particular features and embodiments have been described in an effort to enable those with skill in the art to make and use the claimed invention, it should be understood that several variations, alterations or substitutions can be achieved to fabricate and operate a cork stopper shaving device. Nothing in this description shall be construed as limiting the spirit and scope of the invention as set forth in the claims, below.

FEATURE LIST (100) cork stopper shaving device
(200) receptacle portion
(201) base
(202) wall(s)
(203) periphery
(204) top end
(205) receptacle volume
(206) bottle opener
(207) corkscrew
(208) foil knife
(209) groove
(210) cavity
(300) cutting assembly
(301) planar lid portion
(302) first aperture
(304) first diameter
(305) bottom portion
(306) second aperture
(307) second diameter
(308) conical body
(309) plurality of slots
(310) plurality of shaving elements
(311) blade
(312) terminal edge
(313*a,b*) engagement threads
(315) blade reinforcement
(316) blade engagement surface
(317) inner conical surface
(400*a,b,c*) cork
(401) cork shavings
(500) mating
(A1) opening angle

What is claimed is:

1. A cork stopper shaving device, comprising:
a receptacle portion, the receptacle portion comprising:
a base,
one or more walls extending upwardly from the base to a periphery defined at a top end of the receptacle portion, and
a receptacle volume disposed between the one or more walls, the base, and the periphery;
a cutting assembly, the cutting assembly comprising:
a planar lid portion having a first aperture extending through a volume thereof, the first aperture having a first diameter associated therewith, a bottom portion, and
a conical body extending between the planar lid portion and the bottom portion, the conical body forming an inner-conical surface, the conical body comprising:
a plurality of slots extending through the conical body, and
a plurality of shaving elements, each shaving element of the plurality of shaving elements being disposed adjacent to one of the plurality of slots and configured for cutting material exposed therethrough;
wherein;
the cutting assembly is adapted to couple with the receptacle portion; and
the receptacle portion includes a cavity configured to receive one of a bottle opener, a cork screw, and a foil knife.

2. The device of claim 1, wherein the shaving element comprises a micro serrated blade.

3. The device of claim 1, further comprising a bottle opener, wherein the bottle opener is configured to nest within the cavity disposed on a bottom surface of the receptacle portion.

4. The device of claim 1, further comprising a corkscrew, wherein the corkscrew is pivotally attached and configured to nest within the cavity disposed on a surface of the receptacle portion.

5. The device of claim 4, wherein the corkscrew is adapted to nest into the cavity when configured in a first configuration, and wherein the corkscrew is further adapted to extend outwardly from the receptacle portion when configured in a second configuration.

6. The device of claim 1, further comprising a foil knife, wherein the foil knife is pivotally attached and configured to nest within the cavity disposed on a surface of the receptacle portion.

7. The device of claim 6, wherein the foil knife is adapted to nest into the cavity when configured in a first configuration, and wherein the foil knife is further adapted to extend outwardly from the receptacle portion when configured in a second configuration.

8. The device of claim 1, the planar lid portion of the cutting assembly further comprising a terminal edge, wherein the cutting assembly is adapted to couple with the receptacle portion at a mating of the terminal edge and the periphery, respectively.

9. The device claim 8, wherein the lid portion is coupled to the receptacle portion via a threaded engagement therebetween.

10. The device of claim 8, wherein the lid portion is coupled to the receptacle portion via a friction fitment formed therebetween.

11. The device of claim 1, wherein the inner-conical surface defines an opening angle between 5 degrees and 40 degrees.

12. The device of claim 1, wherein the receptacle portion comprises a contoured surface for ergonomic gripping by a user.

13. The device of claim 1, wherein the device is configured to pass shavings through the plurality of slots.

14. A method for modifying a cork stopper for reuse, the method comprising:

providing the cork stopper shaving device of claim 1;

inserting a cork stopper into the cork stopper shaving device; and applying a rotational force to effectuate shaving of the cork stopper within the device.

* * * * *